US005285590A

United States Patent [19]

Howard

[11] Patent Number: 5,285,590

[45] Date of Patent: Feb. 15, 1994

[54] ANTI-STOVEPIPING MAGAZINE

[76] Inventor: William J. Howard, P.O. Box 573, Wilson, N.C. 27893

[21] Appl. No.: 957,368

[22] Filed: Oct. 7, 1992

[51] Int. Cl.[5] ..... F41A 9/70

[52] U.S. Cl. ..... 42/50

[58] Field of Search ..... 42/7, 18, 22, 50; 89/33.1

[56] References Cited

U.S. PATENT DOCUMENTS

| | | | |
|---|---|---|---|
| 475,061 | 5/1892 | Krnka | 42/18 |
| 2,903,809 | 9/1959 | Stoner | 42/50 |
| 4,107,862 | 8/1978 | Sofinowski | 42/50 |
| 4,397,112 | 8/1983 | York | 42/94 |
| 4,805,333 | 2/1989 | Doria et al. | 42/50 |
| 4,876,813 | 10/1989 | Tuma | 42/50 |
| 4,888,900 | 12/1989 | Howard | 42/50 |
| 5,014,456 | 5/1991 | Kurtz et al. | 42/50 |
| 5,099,595 | 3/1992 | Chestnut et al. | 42/50 |

FOREIGN PATENT DOCUMENTS

| | | | |
|---|---|---|---|
| 651024 | 9/1935 | Fed. Rep. of Germany | 42/50 |

*Primary Examiner*—Stephen C. Bentley
*Attorney, Agent, or Firm*—David R. Murphy

[57] ABSTRACT

A magazine for reliably feeding cartridges to the chamber of a firearm without stovepiping. Each of the cartridges has a uniformly tapered casing holding a projectile which projects from the casing. The magazine has a pair of juxtaposed, cartridge-retaining lips; a spring for biasing the cartridges toward these lips; and a pair of juxtaposed cartridge guides adapted to contact the projectile. These guides preventing orthagonal rotation of the cartridge during feeding of the cartridge to the chamber and this prevent stovepiping.

8 Claims, 3 Drawing Sheets

FIG. 1
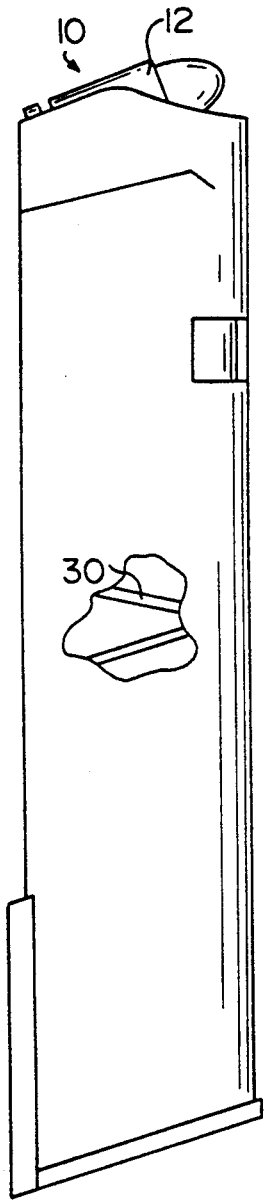
FIG. 2
PRIOR ART
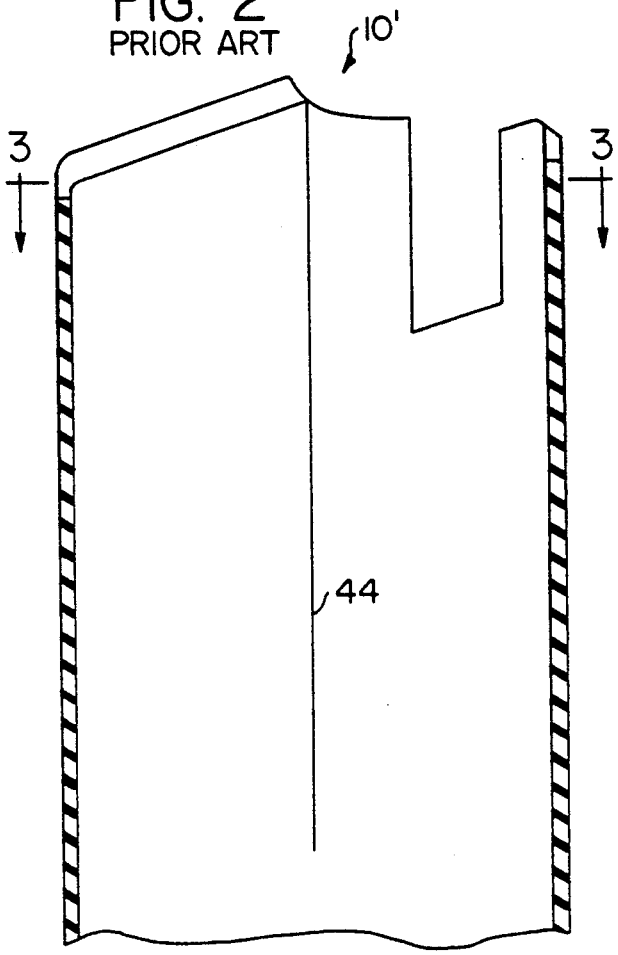
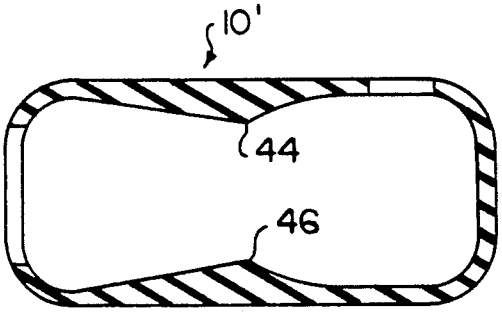
FIG. 3
PRIOR ART

ANTI-STOVEPIPING MAGAZINE

Magazines are devices for holding cartridges and for feeding these cartridges to the chamber of a firearm such as a pistol or a rifle. The ideal magazine would perform these functions rapidly, reliably and without jamming the firearm or otherwise malfunctioning.

Cartridges have a casing containing propellent powder. The rear of the casing is closed by a rim. The other end of the casing receives a projectile.

Cartridges can be divided into two general types (a) those having a shoulder such as the cartridge 26 having shoulder 34 shown in Howard U.S. Pat. No. 4,777,752; and (b) those which have no shoulder and therefore have a casing which is uniformly tapered. Cartridges with uniformly tapered casings generally have a ratio of diameter to length of between about 2.5:1 and 4.5:1. Examples of such cartridges are those commonly called "45 caliber", "nine millimeter", "357 magnum", and "38 special".

Cartridges with uniformly tapered casings are difficult to reliably feed to the chamber of the firearm. A common malfunction occurs when the cartridge undesirably orthagonally rotates about its axis while being fed to the chamber. If this orthagonal rotation is sufficient the cartridge may not enter the chamber. The cartridge may be trapped between the bolt and the entrance to the chamber. This malfunction is common in pistols and has come to be called "stovepiping". This is because the upturned cartridge resembles the pipe for removal of smoke which pipe is attached to a free-standing, wood-burning stove.

Accordingly it is an object of the present invention to provide an improved magazine for uniformly tapered cartridges which is free of one or more of the problems of prior magazines.

Another object is to provide an improved magazine which rapidly and reliably feeds cartridges to the chamber of a bolt-equipped firearm.

Yet another object of the present invention is to provide an improved magazine which does not exhibit the undesirable phenomenon of stovepiping.

Figure 4:
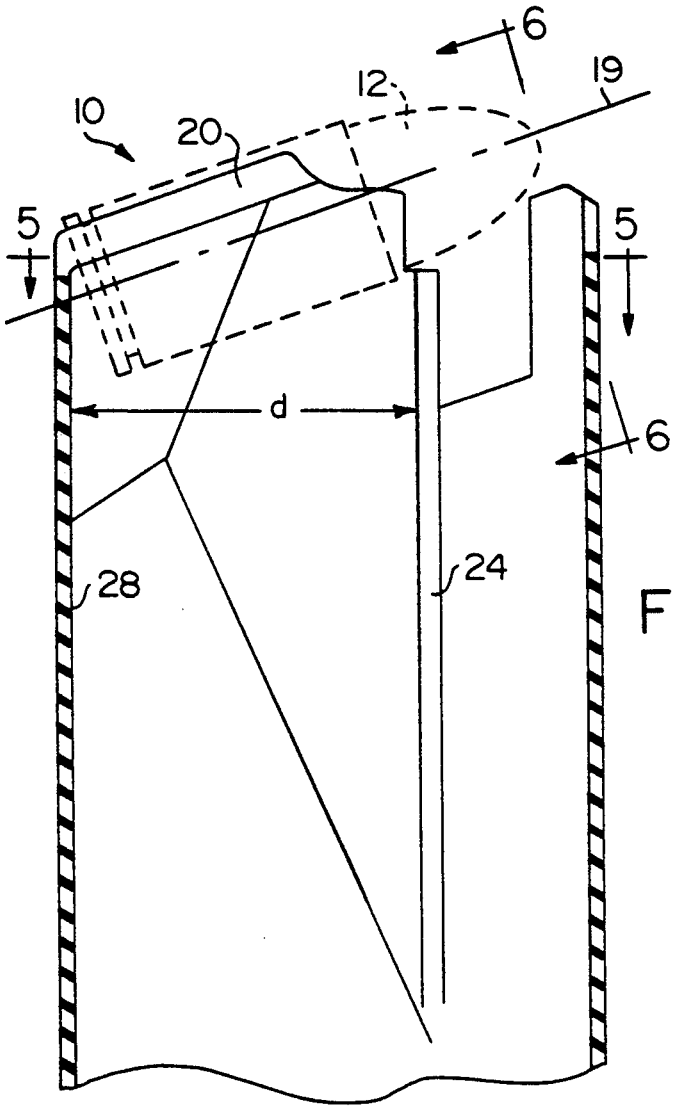
Figure 5:
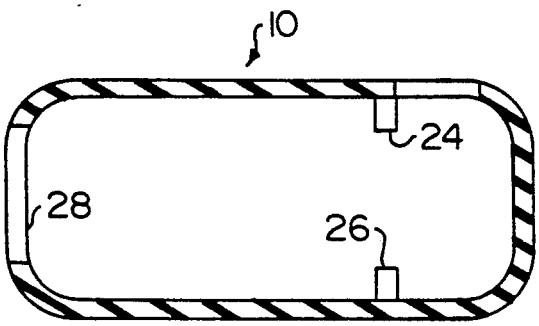
Figure 6:
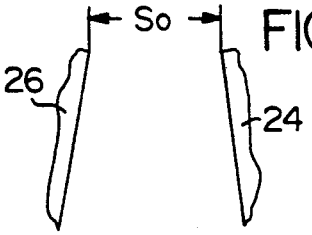
Figure 10:
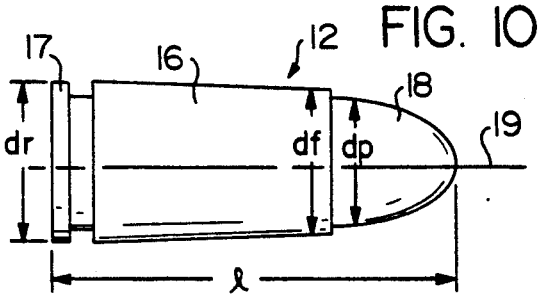
Figure 7:
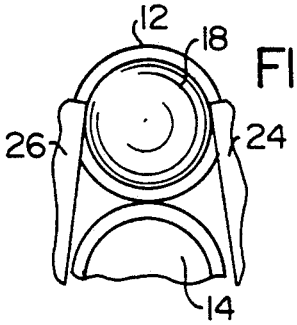
Figure 11:
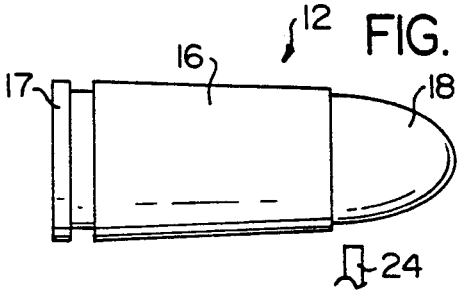
Figure 8:
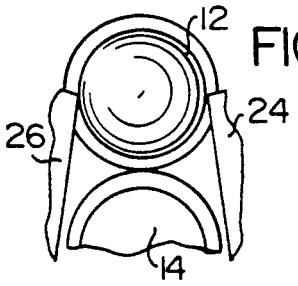
Figure 12:
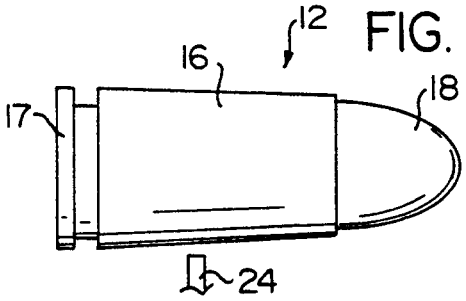
Figure 9:
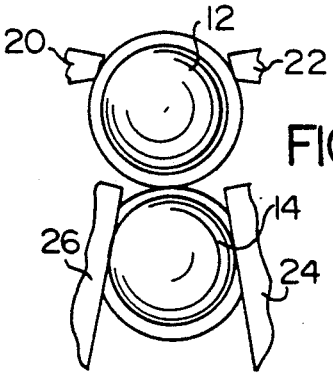
Figure 13:
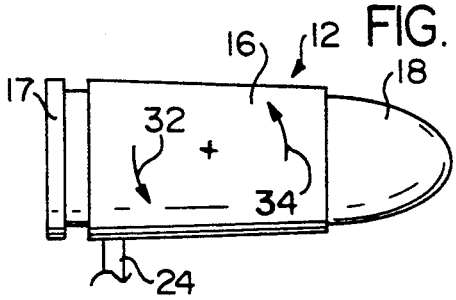
Figure 14:
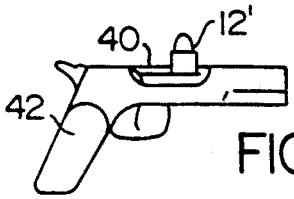

Additional objects and advantages will be immediately apparent to those skilled in the art by reference to the following detailed description and drawings wherein:

FIG. 1 is a full-sized, side view of the outside of a magazine of the present invention; and FIG. 2 is an enlarged sectional view of a prior art magazine; and FIG. 3 is an enlarged sectional view of the prior art magazine of FIG. 2, taken along Line 3—3 of FIG. 2; and FIG. 4 is an enlarged sectional view of a magazine of the present invention with the uppermost cartridge shown in phantom; and FIG. 5 is an enlarged sectional view taken along Line 5—5 of FIG. 4; and FIG. 6 is an enlarged schematic representation of the magazine of the present invention taken along Line 6—6 of FIG. 4, showing the structure and function of guides but with no cartridge present; and FIG. 7 is an enlarged schematic representation of the structure of the magazine of the present invention taken along Line 6—6 of FIG. 4 showing a cartridge just contacting the guides; and FIG. 8 is an enlarged schematic representation of the structure of the magazine of the present invention taken along Line 6—6 of FIG. 4 showing the guides at their maximum expansion; and FIG. 9 is an enlarged schematic representation of the structure of the magazine of the present invention taken along Line 6—6 of FIG. 4 with the uppermost cartridge in contact with cartridge-retaining lips; and FIG. 10 an enlarged view of a cartridge useful with the magazines of the present invention; and FIG. 11 is an enlarged view of a cartridge showing its relationship to one of the guides when the cartridge is in the position shown in FIGS. 4 and 9; and FIG. 12 is an enlarged view of a cartridge showing its relationship to the same guide shown in FIG. 11 after there has been relative movement of the cartridge towards the chamber by an amount approximately equal to half the length of the cartridge casing; and FIG. 13 is an enlarged view of a cartridge showing its relationship to the same guide shown in FIG. 11 after there has been relative movement of the cartridge towards the chamber by an amount approximately equal to the full length of the cartridge casing; and FIG. 14 is a view of a firearm showing the undesirable phenomenon of stovepiping that is avoided by the present invention.

According to the present invention, there is provided a magazine for reliably feeding cartridges to the chamber of a firearm without stovepiping. In the magazine of the present invention each cartridge is symmetrical about a longitudinal axis. Furthermore each cartridge has a substantially uniform casing holding a projectile which projects from the casing.

The magazine of the present invention comprises:

A. a pair of juxtaposed, cartridge-retaining lips; and

B. a spring which provides means for biasing the cartridges toward the cartridge-retaining lips; and C. a pair of juxtaposed cartridge guides adapted to contact the projectile. These guides constitute means for preventing undesirable orthagonal rotation of the cartridge orthagonal to the axis of the cartridge, during feeding of the cartridge to the chamber. When the cartridge cannot orthagonally rotate it cannot exhibit the undesirable phenomenon called stovepiping.

In a preferred embodiment, the present invention further comprises:

(a) means for contacting the projectile at a point on the projectile adjacent to the cartridge casing; and/or (b) a pair of juxtaposed cartridge guides adapted to contact the projectile of the uppermost cartridge.

In another preferred embodiment the cartridge guides are spaced apart a distance substantially equal to the diameter of that portion of the projectile adjacent to the casing; and/or the guides constitute means for preventing orthagonal rotation of the cartridge during feeding of the cartridge to the chamber; and/or the guides constitute means for supporting the bottom of the casing during substantially the entire period of travel of the cartridge toward the chamber.

Referring now to the drawings in general and in particular to FIGS. 1, and 4 through 9, there is shown a magazine 10 of the present invention for reliably feeding cartridges to the chamber (not shown) of a firearm (not shown) without stovepiping. The cartridges such as the cartridges 12, 14 are in a vertical row and are parallel to each other.

As shown in FIG. 10 the cartridge 12 has a casing 16 terminating in a rim 17. The diameter (dr) of the rim 17 has a certain value characteristic of the particular ammunition. In the case of 9 mm ammunition, dr=9 mm. The outside diameter (df) of the front of the casing is slightly smaller. This difference is specified for each type of ammunition. The diameter (df) of the front is typically from about 0.001 to 2 mm less than the diameter (dr) of the rim. The casing 16 is uniformly tapered from the front to the rim 17. The length (1) of the cartridge 12 is specified for each type of ammunition. In the case of 9 mm ammunition it is about 30 mm. Thus the length to diameter ratio of 9 mm ammunition is 30/9 or 3.33.

Within the casing 16 is a projectile 18. The outside diameter (dp) of the projectile 18 is substantially equal to the inside diameter (not shown) of the open end of the casing 16. The cartridge 12 has a central axis 19.

The magazine 10 further comprises a left cartridge-retaining lip 20 and a right cartridge retaining lip 22 (See FIG. 9). This pair of cartridge retaining lips 20, 22 are juxtaposed to each other. The lips 20, 22 are parallel to the axis 19 of the uppermost cartridge 16. The lips 20, 22 are parallel to each other along their entire length; and are spaced from each other a distance less than the diameter of the casing of the cartridge 12.

The magazine 10 has a left guide 24 and a right guide 26. The guides 24, 26 are juxtaposed to each other and are spaced from the rear wall 28 of the magazine 10 a distance (d) slightly greater than the length of the casing 16. The guides 24, 26 are adapted to contact the projectile 18 at a point on the projectile 18 adjacent to that portion of the projectile 18 which extends into the casing 16.

Referring now to FIGS. 6–13 it can been seen how the novel structure of the magazine 10 of the present invention prevents stovepiping. As shown in FIG. 6, when there are no cartridges in the magazine 10 the guides are at rest and are spaced from each other distance $s_o$. The magazines of the present invention are constructed such that $s_o$ is from 0.01 to 2.00 mm less than the diameter (dp) of the projectile 12.

As shown in FIG. 7, as the cartridges 12, 14 move upward under the influence of the pressure exerted on them by the spring 30, the guides 24, 26 first contact the projectile 18 of the uppermost cartridge 12 at a point on the projectile 18 adjacent to its casing 16. Under the influence of the upward movement caused by the spring 30, the cartridge 12 forces the guides 24, 26 to expand outwardly as shown in FIG. 8. This permits upward passage of the cartridge 12.

As shown in FIG. 9, the guides 24, 26 then return to their at rest position. Thus the distance, $s_o$, between the guides 24, 26 is the same in both FIGS. 6 and 9.

FIG. 11 shows the relationship between the cartridge 12 and the left guide 24 when the cartridge is in the position shown in FIGS. 4 and 9. In order to feed the cartridge 12 into the chamber (not shown), the bolt (not shown) advances causing relative movement between the cartridge 12 and the guides 24, 26. As the cartridge 12 moves forward, the guides 24, 26 prevent any downward orthagonal rotation of the rim 17 of the cartridge 12 by supporting the cartridge 12 thereby preventing both downward orthagonal rotation of the rim 17 in the direction of the arrow 32 as well as upward orthagonal rotation of the projectile 18 in the direction of the arrow 34. When the projectile 12 is prevented from rotating it is prevented from stovepiping as shown in FIG. 14.

FIG. 2 shows a prior art magazine 10' which is subject to the undesirable phenomenon of stove piping. As shown in FIG. 14, the bolt 40 of the firearm 42, in this case a pistol, has trapped a cartridge 12' in the stovepipe position. In this position the cartridge 12' has undesirably orthagonally rotated 90° counter clockwise in the direction of the arrow 34 of FIG. 13. As shown in FIGS. 2 and 3 the prior art magazine 10' has a guides 44, 46 which are completely different than the guides 24, 26 and the other structure of the inventive magazine 10. The guides 44, 46 are positioned differently in the prior art. Furthermore these prior art guides do not prevent stovepiping.

As used herein the term "forward" means toward the target, that is to the right in FIG. 14. As used herein the term "upward" means from the bottom of the magazine toward the firearm in the general orientation of the firearm 42. The term "orthagonal" refers to a plane perpendicular to a line generally the axis 19 of the cartridge 12.

The magazine 10 of the present invention can be constructed of metal, plastic, or other material. It is however preferably constructed of an organic plastic composition. A wide variety of organic plastics can be employed if they have the proper physical properties of strength, resilience and toughness. Organic plastics such as polyesters, polyamides, polyethylene and polypropylene are candidates. The compositions preferably contain fibers. The fibers can be themselves of organic plastic, or they can be metal or glass. Glass fibers are preferred. The compositions can also contain opacifying amounts of fillers such as carbon black. The preferred composition is a fiber-filled nylon sold by the Dupont Chemical Company of Wilmington, Del., USA, under the trade name "ZYTEL".

The magazine of the present invention can be used with all types of firearms such as pistols, rifles, and machine guns.

As previously stated the present invention takes advantage of the fact that the cartridges useful with the magazine of the present invention, are uniformly tapered. The amount of this taper is set by the manufacturing standards which relate to the cartridges themselves and forms no part of the present invention. In fact the angle of taper can be zero.

Although the invention has been described in considerable detail with respect to certain preferred embodiments thereof, it will be understood that modifications can be made without departing from the spirit of the invention as described above and as defined in the appended claims.

What is claimed is:

1. A magazine for reliably feeding cartridges to the chamber of a firearm without stovepiping;

wherein each of the cartridges comprises a uniformly tapered casing holding a projectile which projects from the casing;

wherein said magazine comprises:

A. a pair of juxtaposed, cartridge-retaining lips simultaneously contacting the projectile of the uppermost cartridge; and B. spring means for biasing the cartridges toward the cartridge-retaining lips; and C. a pair of juxtaposed cartridge guides spaced from each other a distance less than said outside diameter of said projectile to simultaneously contact the uppermost projectile and constituting means for preventing orthagonal rotation of the uppermost cartridge during feeding of the uppermost cartridge to the chamber.

2. The magazine of claim 1 further comprising means for contacting the projectile at a point on the projectile adjacent to the cartridge casing.

3. The magazine of claim 1 of an organic polymeric thermoplastic composition.

4. The magazine of claim 3 wherein the thermoplastic is nylon.

5. The magazine of claim 3 wherein the composition contains glass fibers.

6. The magazine of claim 3 wherein the composition contains carbon black.

7. A magazine for reliably feeding cartridges to the chamber of a firearm without stovepiping; and wherein each of the cartridges has a cartridge axis of orthagonal rotation; and wherein each of the cartridges is symmetrical about the axis of rotation; and wherein each cartridge comprises a uniformly tapered casing holding a projectile which projects from the casing; and wherein the outside diameter of the casing is greater than the outside of that portion of the projectile adjacent to the casing; and wherein said magazine comprises:

A. a pair of juxtaposed, cartridge-retaining lips parallel to the axis rotation of the uppermost of the cartridges; and wherein said lips simultaneously contact the projectile of the uppermost cartridge; and B. spring means for biasing the cartridges toward the cartridge-retaining lips; and C. a pair of juxtaposed cartridge guides spaced from each other a distance less than said outside diameter of said projectile to contact the projectile of the uppermost cartridge; and (i) wherein the cartridge guides are spaced apart a distance substantially equal to the diameter of that portion of the projectile adjacent to the casing; and (ii) wherein the guides simultaneously contact the uppermost cartridge and wherein the guides constitute means for preventing orthagonal rotation to the uppermost cartridge during feeding of the uppermost rotation of the chamber; and (iii) wherein the guides constitute means for supporting the bottom of the casing during substantially the entire period of travel of the cartridge toward the chamber.

8. A magazine for reliably feeding 9 mm cartridges to the chamber of a pistol without stovepiping;

wherein the cartridges are in a row parallel to each other; and wherein each cartridge comprises a uniformly tapered casing and a projectile within the casing wherein the outside diameter of the projectile is substantially equal to the inside diameter of the open end of the cartridge; and wherein the magazine is a fiber glass filled nylon; and wherein said magazine comprises:

A. a pair of juxtaposed, cartridge-retaining lips which:

(i) are parallel to the axis of the uppermost cartridge in the magazine; and (ii) are parallel to each other along their entire length; and (iii) are spaced from each other a distance less than the diameter of the cartridge casing; and B. a pair of left and right cartridge guides juxtaposed to each other wherein the cartridge guides:

(i) are spaced from the rear wall of the magazine a distance slightly greater than the length of the cartridge casing; and (ii) are spaced from each other a distance less than said outside diameter of said projectile to contact the projectile at a point on the projectile adjacent to that portion of the projectile which extends into the cartridge casing.

* * * * *